US005787721A

United States Patent [19]

Fromm et al.

[11] Patent Number: 5,787,721

[45] Date of Patent: Aug. 4, 1998

[54] EASILY REMOVABLE DRAIN PAN AND FUNNEL ARRANGEMENT

[75] Inventors: Dale E. Fromm, Onalaska, Wis.; Dwayne L. Johnson, La Crescent, Minn.

[73] Assignee: American Standard Inc., Piscataway, N.J.

[21] Appl. No.: 984,725

[22] Filed: Dec. 4, 1997

[51] Int. Cl.[6] ..... F25D 21/14

[52] U.S. Cl. ..... 62/285; 62/272

[58] Field of Search ..... 62/285, 288, 289, 62/291, 272; 285/18, 29, 61, 119, 406, 407, 408, 417

[56] References Cited

U.S. PATENT DOCUMENTS

| | | | |
|---|---|---|---|
| 2,030,923 | 2/1936 | Hopkins | 62/285 |
| 2,797,560 | 7/1957 | Kooiker et al. | 62/285 |
| 4,416,327 | 11/1983 | Nakada et al. | 165/122 |
| 4,597,269 | 7/1986 | Kim | 62/286 |
| 4,907,420 | 3/1990 | Mahanay et al. | 62/291 |
| 4,970,875 | 11/1990 | Kim | 62/272 |
| 4,974,421 | 12/1990 | Kim | 62/272 |
| 4,986,087 | 1/1991 | Sullivan | 62/291 |
| 5,042,269 | 8/1991 | Sullivan | 62/285 |
| 5,113,667 | 5/1992 | Sullivan | 62/291 |
| 5,117,653 | 6/1992 | Kil | 62/291 |
| 5,152,154 | 10/1992 | Sullivan | 62/291 |
| 5,195,332 | 3/1993 | Sullivan | 62/291 |
| 5,199,276 | 4/1993 | Sullivan | 62/291 |

*Primary Examiner*—John M. Sollecito
*Attorney, Agent, or Firm*—William J. Beres; William O'Driscoll; Peter D. Ferguson

[57] ABSTRACT

A drain spout that is easy to remove for cleaning and for accessing components behind or proximal to the drain pan. Instead of directly connecting the drain hose to the drain pan outlet spout, the drain hose connects to a drain funnel attached to or formed as a part of the shelf supporting the drain pan. The drain pan itself sits on the shelf and the outlet spout of the drain pan fits within the shelf funnel without a positive connection. The drain pan can be lifted out without disengaging the drain hose.

9 Claims, 3 Drawing Sheets

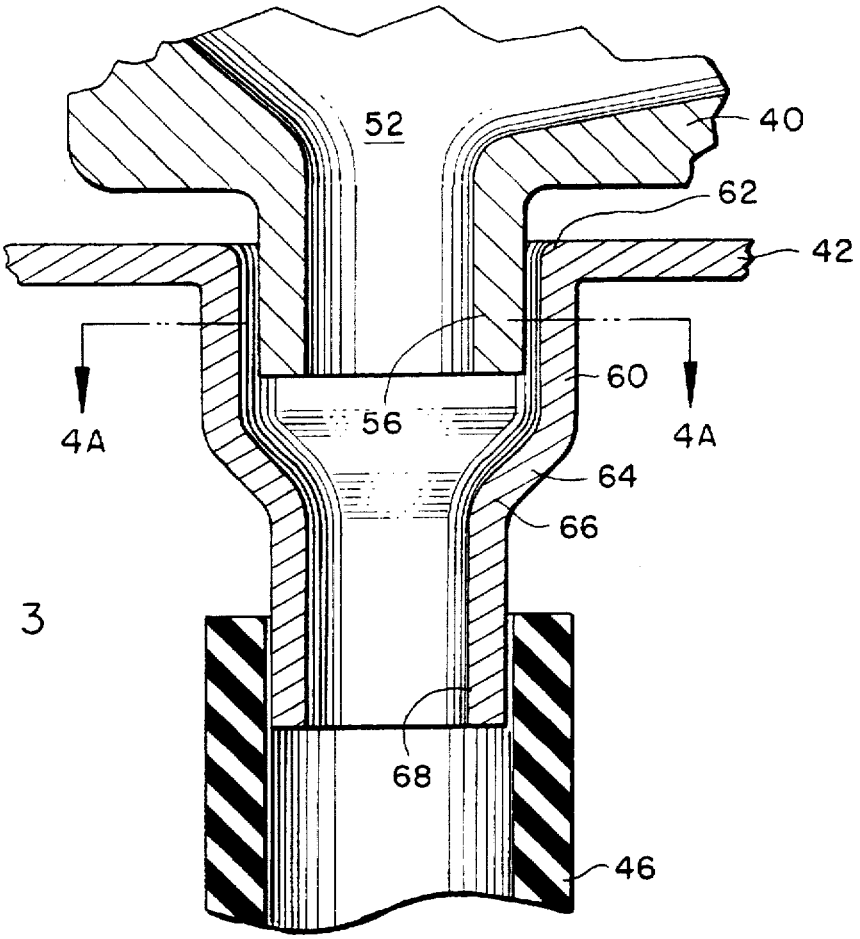
FIG. 3
FIG. 4A
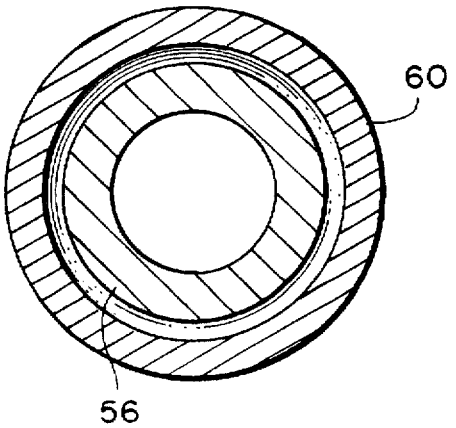
FIG. 4B
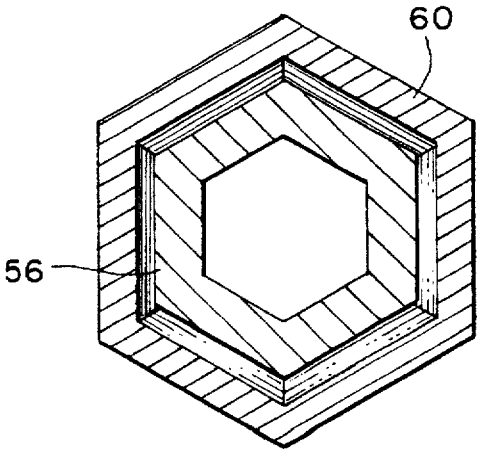

EASILY REMOVABLE DRAIN PAN AND FUNNEL ARRANGEMENT

BACKGROUND OF THE INVENTION

The present invention is directed to the problem of providing a drain pan that is easy to remove for cleaning and for accessing components behind or proximal to the drain pan.

Drain pans collect condensate or other liquids that are shed by heat exchangers and dehumidifiers in typical air conditioning units while these units operate. The drain pan is supported in the unit by a shelf or equivalent. Either the shelf is sloped so that condensate runs down to a low spot for collection and removal, or the shelf is level and the drain pan design itself contains the slope. The typical removal method is for the condensate to run out through an outlet such as an outlet spout that is located in the lowest portion of the drain pan. The outlet spout typically penetrates the shelf through a clearance hole and directly attaches to a drain line such as a flexible hose, usually the attachment being accomplished by a fastener such as a radiator clamp. The drain line then directs the condensate away for disposal.

In these systems, the drain line must be removed from the drain spout in order to remove the drain pan. It is desirable to remove the drain pan either for cleaning or to allow access to components behind or near the drain pan.

Problems arise when removing the drain pan. The clamp attaching the drain line to the spout is sometimes difficult to access. Additionally, the spout of a one piece molded drain pan is sometimes formed from a thin material which is subject to damage if manipulated frequently or carelessly. Moreover, the length of protrusion of the spout of a one piece molded drain pan is limited by the molding process and by practical material thickness. On the other hand, the shorter the spout, the more difficult it is to attach the drain line and clamp. It is desirable to provide an easily removable drain pan because the greater time and effort involved in removing the drain line deters proper maintenance and cleaning of the drain pan itself and of any components behind the pan (such as filters) which may require periodic maintenance.

SUMMARY OF THE INVENTION

It is an object, feature and advantage of the present invention to solve the problems of the prior art drain pans.

It is an object, feature and advantage of the present invention to avoid direct attachment of the drain spout to the drain line.

It is an object, feature and advantage of the present invention to provide a drain pan that can be lifted out without the necessity of disengaging the drain line.

It is an object, feature and advantage of the present invention to provide a drain pan arrangement where there is no direct connection between the drain pan and the drain line.

It is a further object, feature and advantage of the present invention to allow this drain pan to be lifted out for removal without further effort or manipulation of the spout or drain so as to promote regular maintenance and cleaning.

It is an object, feature and advantage of the present invention to simplify drain pan design and manufacture by providing a shorter and less critical spout geometry.

It is an object, feature and advantage of the present invention to provide a novel and low cost approach to a drain pan that is easy to remove for cleaning and/or access to unit components in the area of the drain pan.

It is an object, feature and advantage of the present invention to have a self locating drain pan.

It is an object, feature and advantage of the present invention to provide a drain funnel on a shelf supporting a drain pan, where the drain funnel includes a spout portion having substantially the same diameter as the drain pan spout.

The present invention provides a drain pan arrangement for a heat exchanger or dehumidifier coil. The arrangement comprises: a coil which condenses a vapor into a liquid, the liquid dropping from the coil; and a drain pan arranged to catch the liquid, the drain pan having a downwardly projecting drainage stub and the drain pan being arranged to direct the liquid into the stub. The arrangement also comprises a drain pan support supporting the drain pan and having an aperture and a downwardly projecting barrel about the aperture, the aperture receiving, but not engaging the stub; and including drainage conduit operatively connected to the barrel. The barrel may have a large diameter portion around the stub and a small diameter portion operatively connected to the drainage conduit. The stub may have a diameter which is substantially the same as the diameter of the small barrel portion. The drain pan is removable from the drain pan support without disconnecting the drainage conduit.

The present invention further provides a draining arrangement. The draining arrangement comprises: a drain pan having an outlet and a downwardly projecting stub arranged about the outlet, and a body shaped or arranged to direct condensate to the outlet; a drain pan support shelf supporting the drain pan, the support shelf including an aperture receiving the projecting stub; and a funnel arrangement located proximal the aperture. The funnel arrangement includes a barrel portion adapted to receive the stub, a funnel portion narrowingly radially inwardly, and a spout portion adapted for connection to a drain line.

The present invention also provides a method of assembling and cleaning a drain pan comprising the steps of: providing a drain pan, a drain pan support and a drainage conduit; fastening the drainage conduit to the drain pan support; and placing the drain pan on the drain pan support while taking no positive steps to fasten the drain pan in place. The method includes the further steps of: taking no positive steps to unfasten the drain pan; lifting the drain pan out; cleaning the drain pan; and replacing the drain pan.

BRIEF DESCRIPTION OF THE DRAWING

FIG. 3 shows a detailed view of a portion of FIG. 2.

FIG. 4A shows a preferred embodiment of the present invention taken along lines 4—4 of FIG. 3.

FIG. 4B shows an alternative embodiment of the present invention taken along lines 4—4 of FIG. 3.

DETAILED DESCRIPTION OF THE DRAWING

The present invention is directed to an improved drain pan for an air conditioning unit which is easy to remove for cleaning or for access to components located proximal to the drain pan.

Figure 1:
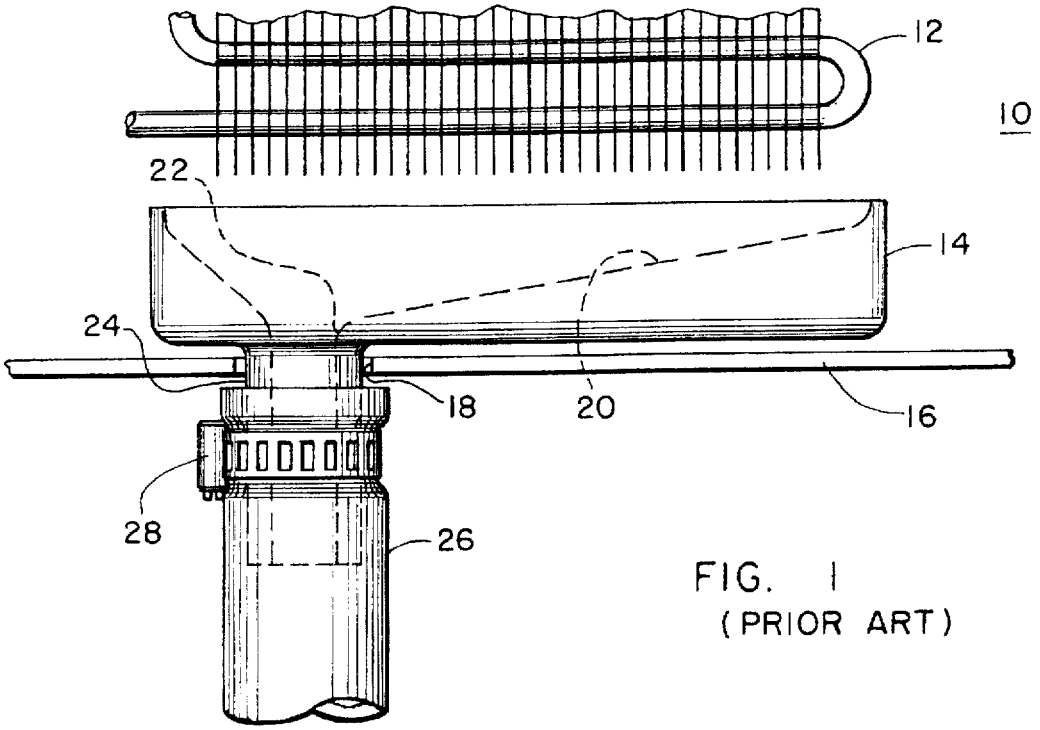
FIG. 1 (PRIOR ART)
FIG. 1 shows a prior art drain pan, shelf and drain line arrangement.

FIG. 1 shows a prior art arrangement 10 including a heat exchanger 12 dripping condensate into a drain pan 14. The drain pan 14 is supported by a shelf 16 which includes an aperture 18. Either the shelf is sloped so that the condensate runs down to a low spot for collection or removal, or the shelf 16 is generally level and the drain pan design contains a slope 20 functioning as a funnel to direct condensate to a low spot 22. An outlet spout 24 is located and formed at the low spot 22 to direct condensate out of the drain pan 14. The outlet spout 24 penetrates the shelf 16 through the aperture 18 and directly attaches to a drain line 26. The drain line 26 is typically secured to the outer surface of the outlet spout 24 by a fastener such as a hose clamp 28.

In order to remove the drain pan 14 for cleaning or to allow access to components behind or proximal to the drain pan 14, the drain line 26 must be removed from the outlet spout 24. Since the drain line is typically a flexible hose which is clamped by the clamp 28 to the outlet spout 24, the clamp 28 must be first released, and the drain line 26 removed from the outlet spout 24 before the drain pan 14 can be removed. In general, the clamp 28 is sometimes difficult to access, the flexible hose 26 may bond to the outlet spout 24, the outlet spout 24 itself may suffer damage if it is formed of a thin material and if it is manipulated too often, and the usable length of the outlet spout 24 for a molded one piece drain pan may be limited due to existing manufacturing techniques.

Figure 2:
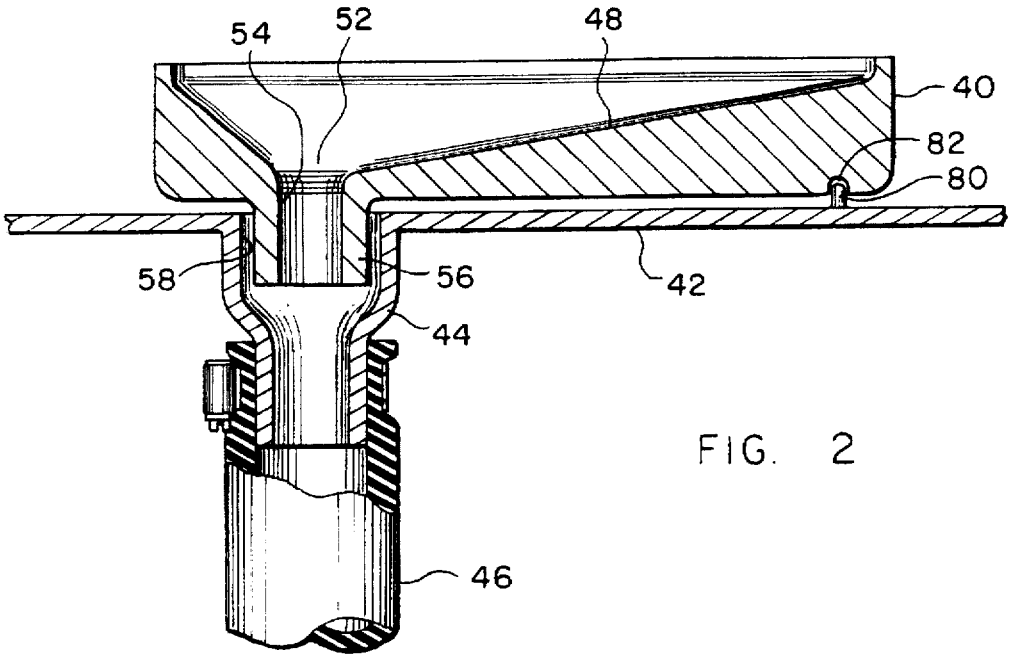
FIG. 2 shows a drain pan, shelf, drain funnel and drain line arrangement in accordance with the present invention.
Figure 6:
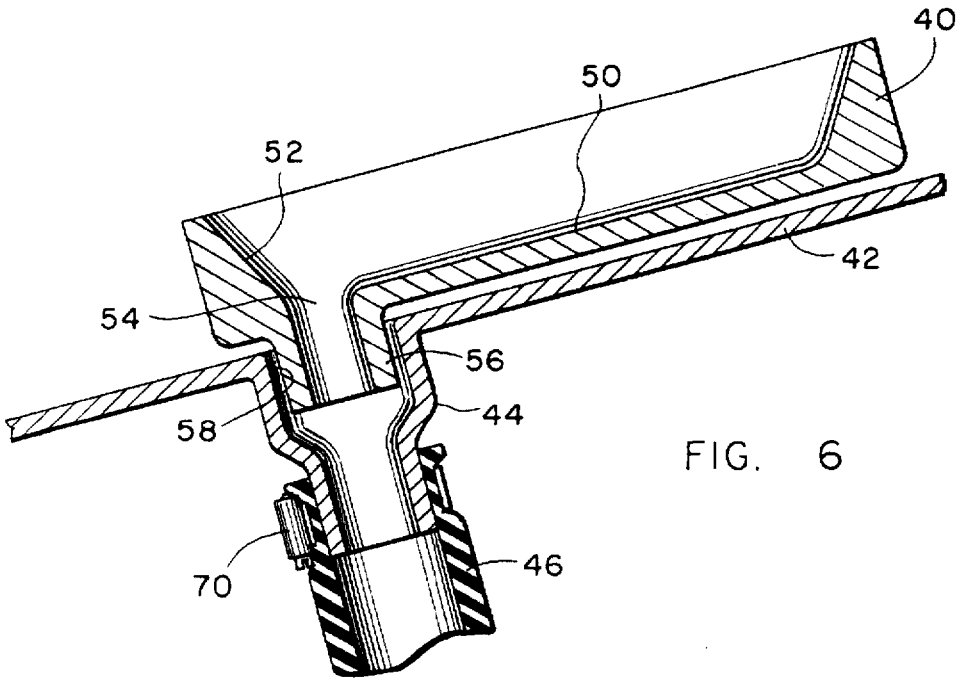
FIG. 6 illustrates another preferred embodiment of the present invention showing a sloped shelf and level drain pan.

FIG. 2 shows a drain pan 40, a shelf 42, a drain funnel 44 and a drain line 46 in accordance with the present invention. As discussed previously, the drain pan 44 either includes an internal funnel arrangement 48 or the shelf 42 is sloped as shown in FIG. 6 and the drain pan 40 has a generally level interior 50. In either case, the drain pan 40 has a low spot 52 and an outlet 54 located at that low spot. A downwardly projecting stub 56 is arranged and formed around the outlet 54 and is adapted to fit within an aperture 58 in the shelf 42.

Unlike the drain pan shown in FIG. 1, the drain pan shown in FIGS. 2–6 does not include an outlet spout which directly engages a drain line. Instead, the arrangements of FIGS. 2–6 include the funnel arrangement 44 attached to and projecting from the shelf 42.

The funnel arrangement 44 can be seen in FIG. 3 as including a generally cylindrical barrel portion 60 having a first end 62 attached to or formed integrally with the shelf 42 and having a second end 64 leading to and connecting with a funnel portion 66. The funnel portion 66 narrows radially inward and terminates at an axially extending spout portion 68. The drain line 46 is clamped by a clamp 70 to the spout portion 68. Preferably, the spout portion 68 has the same general diameter as the outlet spout 24 so as to allow it to be completely interchangeable with and retrofitable to previous systems.

In operation condensate drains into the drain pan 40 and is channeled to the low spot 52. From the low spot 52, the condensate drains through the outlet 54, through the stub 56, into the barrel portion 60 and then into the funnel portions 66 of the funnel arrangement 44. The condensate then drains down into the spout portion 68 and then into the drain line 46 where the condensate is conventionally disposed of.

Referring to FIG. 2, it can be seen that the drain pan 40 is not positively attached to the drain line 46. In fact, the drain pan 40 is not positively attached to anything. Therefore the drain pan 40 is easily removable by lifting for cleaning or to provide access to components behind or proximal to the drain pan 40. To better locate the drain pan 40, an optional positioning knob or knobs 80 may be provided on the shelf 42 to fit within a positioning aperture or apertures 82 of the drain pan 40 so as to locate the drain pan 40 with respect to the shelf 42.

FIG. 4A illustrates the preferred embodiment of the present invention taken along lines 4—4 of FIG. 3. It can be seen that the stub 56 and the barrel portion 60 are both circular in cross-section and loosely engage.

FIG. 4B illustrates that the cross-section of the stub 56 and the barrel 60 may be of other shapes including the hexagonal shape shown in this figure.

Figure 5:
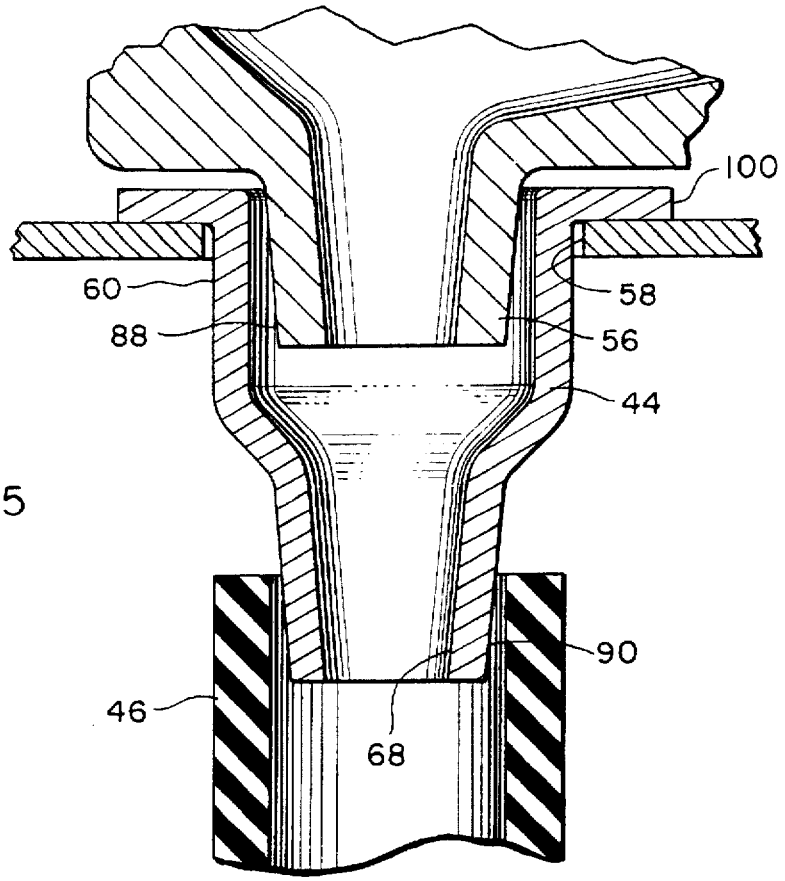
FIG. 5 shows an alternative embodiment of the present invention as modified from FIG. 3.

FIG. 5 illustrates several alternative embodiments to FIG. 3. The stub portion 56 may be radially tapered inwardly and downwardly about the barrel portions axis so as to facilitate insertion in the barrel portion 60. The taper 88 of the stub 56 is just enough to allow easy assembly. Similarly, the spout portion 68 may be tapered radially inwardly and downwardly about the barrel portions axis so as to facilitate insertion into the drain line 46. The taper 90 of the spout portion 68 is also just enough to allow easy assembly.

FIG. 5 also illustrates that the funnel arrangement 44 may be an insert which is not directly attached to or formed as a part of the shelf 42 but merely fits within the aperture 50 and includes a radial flange 100 overlaying the shelf 42 and held in place either by the weight of the drain pan 40, by the weight of the connected drain line 46, by conventional fastening techniques such as soldering, welding, adhesives or interference fit, or by a conventional fastening device such as a rivet or a screw.

The present invention is disclosed a novel and unique way of configuring a low cost and easily manufacturable drain pan that is easy to remove from an air conditioning unit. It will be clear to a person of ordinary skill in the art that many modifications and alterations can be made in the present invention including adapting the present invention to various conventional drain pans having outlet spouts or varying drain line connections. All such modifications and alterations are contemplated to fall within the spirit and scope of the present invention.

What is desired to be secured for Letters Patent of the United States is claimed as follows:

1. A drain pan arrangement for a heat exchanger or dehumidifier coil comprising:

a coil which condenses a vapor into a liquid, the liquid dropping from the coil;

a drain pan arranged to catch the liquid, the drain pan having a downwardly projecting drainage stub and the drain pan being arranged to direct the liquid into the stub;

a drain pan support supporting the drain pan and having an aperture and a downwardly projecting barrel arranged about the aperture, the aperture receiving the stub; and drainage conduit operatively connected to the barrel.

2. The arrangement of claim 1 wherein the barrel has a large diameter portion arranged around the stub and a small diameter portion operatively connected to the drainage conduit.

3. The arrangement of claim 2 wherein the stub has a diameter which is substantially the same as the diameter of the small barrel portion.

4. The arrangement of claim 3 wherein the drain pan is removable from the drain pan support without disconnecting the drainage conduit.

5. The arrangement of claim 4 wherein the barrel is an insert which fits within the aperture.

6. The arrangement of claim 5 wherein the insert has a radial flange adapted to overlay the drain pan support.

7. The arrangement of claim 2 wherein the barrel has an axis and the small diameter portion is tapered inwardly toward the axis.

8. The arrangement of claim 7 wherein the large diameter portion is tapered inwardly towards the axis.

9. The arrangement of claim 2 wherein the barrel has a circular or a hexagonal cross section.

* * * * *